US008353351B2

(12) United States Patent
Carpenter et al.

(10) Patent No.: US 8,353,351 B2
(45) Date of Patent: Jan. 15, 2013

(54) SYSTEM AND METHOD FOR REGULATING PRESSURE WITHIN A WELL ANNULUS

(75) Inventors: Robert B. Carpenter, Tomball, TX (US); Omid Oujani, Houston, TX (US); Krystian K. Maskos, Houston, TX (US); John Lofton, Woodlands, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 293 days.

(21) Appl. No.: 12/784,367

(22) Filed: May 20, 2010

(65) Prior Publication Data

US 2011/0284209 A1 Nov. 24, 2011

(51) Int. Cl.
*E21B 21/00* (2006.01)

(52) U.S. Cl. ..... 166/338; 166/344; 166/347; 166/351; 166/311

(58) Field of Classification Search ..... 166/338, 166/344–347, 351, 367, 368, 311, 90.1, 369; 175/207, 209, 218
See application file for complete search history.

(56) References Cited

U.S. PATENT DOCUMENTS

| | | | | | |
|---|---|---|---|---|---|
| 4,216,834 | A | * | 8/1980 | Wardlaw | 175/7 |
| 4,282,939 | A | * | 8/1981 | Maus et al. | 175/7 |
| 4,291,772 | A | * | 9/1981 | Beynet | 175/5 |
| 4,553,429 | A | * | 11/1985 | Evans et al. | 73/152.21 |
| H000594 | H | * | 3/1989 | Adorjan | 138/148 |
| 5,006,845 | A | * | 4/1991 | Calcar et al. | 367/81 |
| 5,273,112 | A | * | 12/1993 | Schultz | 166/374 |
| 5,848,656 | A | * | 12/1998 | Møksvold | 175/7 |
| 5,899,637 | A | * | 5/1999 | Blanchard et al. | 405/210 |
| 5,927,405 | A | * | 7/1999 | Monjure et al. | 166/384 |
| 6,062,313 | A | * | 5/2000 | Moore | 166/357 |
| 6,186,239 | B1 | * | 2/2001 | Monjure et al. | 166/384 |
| 6,293,346 | B1 | * | 9/2001 | Patel | 166/373 |
| 6,457,528 | B1 | * | 10/2002 | Staudt | 166/363 |
| 6,474,422 | B2 | * | 11/2002 | Schubert et al. | 175/69 |
| 6,675,898 | B2 | * | 1/2004 | Staudt | 166/363 |
| 6,736,012 | B1 | * | 5/2004 | Beall et al. | 73/709 |
| 7,048,059 | B2 | * | 5/2006 | Adams et al. | 166/348 |
| 7,086,472 | B1 | * | 8/2006 | Incoronato | 166/357 |
| 7,185,705 | B2 | * | 3/2007 | Fontana | 166/356 |
| 7,191,830 | B2 | * | 3/2007 | McVay et al. | 166/242.1 |
| 7,264,058 | B2 | * | 9/2007 | Fossli | 166/367 |
| 7,441,599 | B2 | * | 10/2008 | Hermes et al. | 166/288 |
| 7,497,266 | B2 | * | 3/2009 | Fossli | 166/358 |
| 7,510,005 | B2 | * | 3/2009 | Coates et al. | 166/288 |
| 7,836,973 | B2 | * | 11/2010 | Belcher et al. | 175/25 |
| 7,866,399 | B2 | * | 1/2011 | Kozicz et al. | 166/367 |
| 7,938,189 | B2 | * | 5/2011 | Rytlewski | 166/337 |

(Continued)

OTHER PUBLICATIONS

ATL Pillow Tanks Catalog, ATL Aero Tec Laboratories Inc., Feb. 2006.

(Continued)

*Primary Examiner* — Matthew Buck
(74) *Attorney, Agent, or Firm* — Pillsbury Winthrop Shaw Pittman LLP

(57) ABSTRACT

Pressure within a subsea well is managed as temperature within the well fluctuate. The management of the pressure mitigates stress to the structure of the well caused by the pressure. To manage the pressure, fluid is received from and/or provided to the well to reduce and/or increase pressure within the well.

20 Claims, 2 Drawing Sheets

U.S. PATENT DOCUMENTS

| | | | | |
|---|---|---|---|---|
| 7,958,948 | B2 * | 6/2011 | Stave | 175/7 |
| 8,066,074 | B2 * | 11/2011 | Maskos et al. | 166/324 |
| 2005/0092523 | A1 * | 5/2005 | McCaskill et al. | 175/38 |
| 2008/0060846 | A1 * | 3/2008 | Belcher et al. | 175/25 |
| 2011/0100710 | A1 * | 5/2011 | Fossli | 175/7 |
| 2011/0253445 | A1 * | 10/2011 | Hannegan et al. | 175/5 |

OTHER PUBLICATIONS

ATL Racing Catalog, ATL High Performance Racing Fuel Cells, ATL Aero Tec Laboratories Inc., Jan. 2008.

* cited by examiner

SYSTEM AND METHOD FOR REGULATING PRESSURE WITHIN A WELL ANNULUS

FIELD OF THE INVENTION

The invention relates to the management of pressure within an annulus of a sub-sea mineral extraction well as temperature within the well fluctuates.

BACKGROUND OF THE INVENTION

Systems that manage pressure within a well annulus of a sub-sea mineral extraction well are known. Some such systems provide a simple one-time pressure release, such as a rupture disc, for releasing pressure within the well great enough to damage the well. Other systems provide for more sophisticated release of fluid out of the well annulus. However, conventional system generally release excess fluid directly into the sea.

In conventional systems wherein provision has been made for communication (venting) to the sea, after a temperature increase has caused fluid to be released from the annulus, seawater is used to replace the fluid as the well cools. Systems with check valves that prevent seawater re-entry into the annulus when it cools are susceptible to well failure caused by the resultant confined annular pressure dropping too low and allowing implosion of one of the annular walls. Systems that do permit seawater to re-enter the annulus expose the casing strings to chloride and biologic corrosion.

SUMMARY

One aspect of the invention relates to a system configured to regulate pressure within a well annulus of a mineral extraction well that extends down through a body of water and through a seabed, wherein the pressure is regulated by managing flows of fluid into and out of the well annulus. In one embodiment, the system comprises one or more conduits, and one or more reservoirs. The one or more conduits are configured to pass through an outer wall of the well between a surface of the body of water and the seabed. The one or more conduits provide one or more pathways through which fluid is communicated between the well annulus and the exterior of the well. The one or more reservoirs are configured to sit between the surface of the body of water and the seabed. The one or more reservoirs are in fluid communication with the one or more conduits such that fluid passing out of the well annulus via the one or more conduits is received into the one or more reservoirs, and such that fluid passing into the well annulus via the one or more conduits comes from the one or more reservoirs.

Another aspect of the invention relates to one or more conduits, and one or more reservoirs. The system is configured to regulate pressure within a well annulus of a fossil fuel extraction well that extends down through a body of water and through a seabed. The pressure is regulated by managing flows of fluid into and out of the well annulus, wherein the fluids flow into and out of the well annulus through an annular drilling tool that provides for fluid communication between the well annulus and the exterior of the well within in the body of water. In one embodiment, the system comprises one or more conduits and one or more reservoirs. The one or more conduits are configured to receive fluid from and provide fluid to the annular drilling tool such that fluid passes back and forth between the well annulus and the one or more conduits through the annular drilling tool. The one or more reservoirs are configured to sit between the surface of the body of water and the seabed. The one or more reservoirs are in fluid communication with the one or more conduits such that fluid passing out of the well annulus via the annular drilling tool and the one or more conduits is received into the one or more reservoirs, and such that fluid passing into the well annulus via the one or more conduits and the annular drilling tool comes from the one or more reservoirs.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
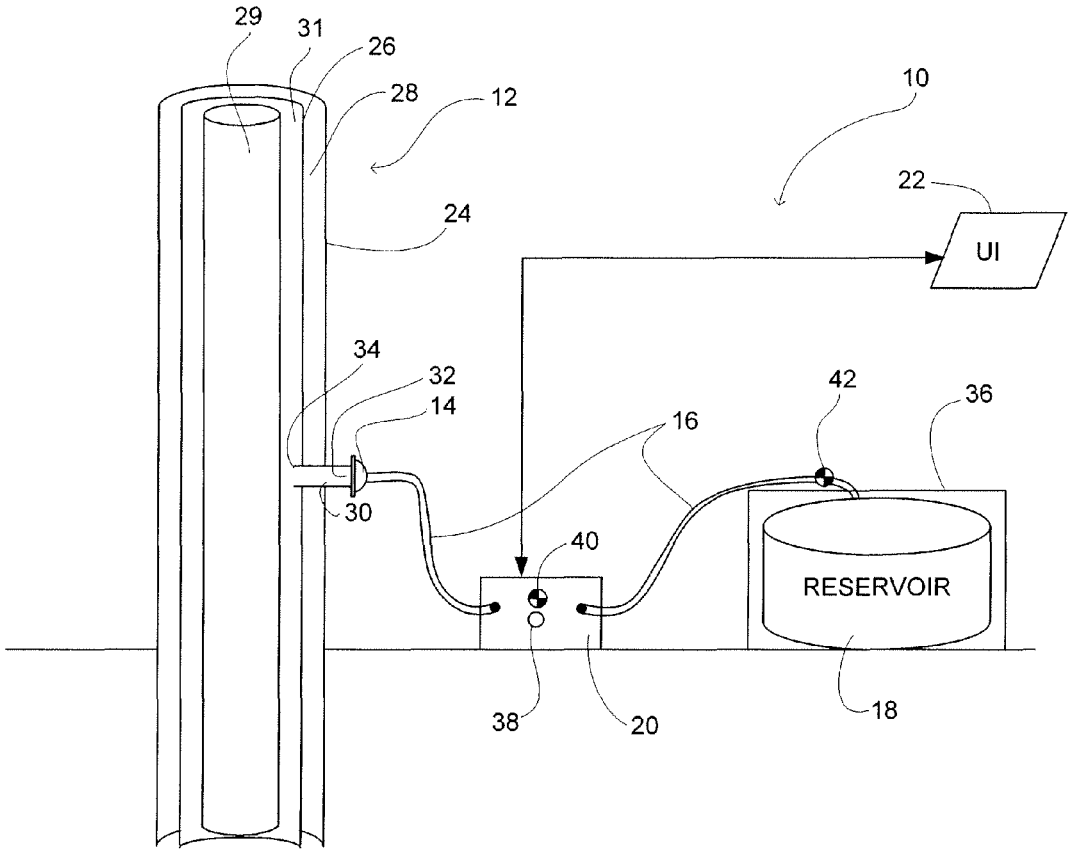
FIG. 1 illustrates a system configured to manage pressure within a sub-sea well, in accordance with one or more embodiments of the invention.

FIG. 1 illustrates a system 10 configured to manage pressure within a sub-sea well 12. The system 10 is configured to manage pressure within well 12 as temperature within well 12 fluctuates, so as to mitigate stress to the structure of well 12 caused by the pressure. To manage the pressure, fluid is received from and/or provided to well 12 to reduce and/or increase pressure within well 12. The fluid is not seawater, but instead is fluid that is maintained at or near the seabed in isolation from seawater. In one embodiment, system 10 includes one or more of a well interface appliance 14, one or more conduits 16, one or more reservoirs 18, a junction 20, a user interface 22, and/or other components.

The well 12 is encased by an outer casing 24 that separates well 12 from the sea aboveground, and separates well 12 from subsurface materials (e.g., rock, water, etc.) underground. Within outer casing 24, an inner casing 26 forms an annular space 28 between the outer surface of inner casing 26 and the inner surface of outer casing 24. A tubular 29 is provided within inner casing 26 that creates an inner annular space 31 between the outer surface of tubular 29 and the inner surface of inner casing 26. It will be appreciated that in one embodiment, additional or fewer casings or tubulars may be included in well 12 inside of inner casing 26, resulting in the formation of more or less well annuluses. However, for ease of illustration, well 12 is described herein with the two annuluses 28 and 31.

During mineral extraction, fluid is passed up to the surface through tubular 29. The movement of fluid within well 12 may result in a rise in temperature within well 12 to increase, thereby causing pressure within well 12 to increase as well. In particular, fluctuations in pressure in annular space 31 caused by mineral extraction (e.g., increases during fluid movement, decreases during periods of inactivity) apply a compressive force to tubular 29, and a burst force to inner casing 26. If the pressure within annular space 31 is not managed, the forces applied by the fluid within annular space 31 may cause a well failure due to collapse (if tubular 29 collapses) or burst (if inner casing 26 bursts).

The well interface appliance 14 is configured to communicate fluid between the interior of well 12 and the exterior of well 12. Specifically, well interface appliance 14 provides a pathway for fluid through outer casing 24 so that fluid within annular space 28 is in communication with the exterior of well 12. The well interface appliance 14 includes a includes a conduit 30 that extends from a proximal end 32 to a distal end 34. The well interface appliance 14 is configured to be disposed in outer casing 24 and inner casing 26 with distal end 34 inside of annular space 31 such that conduit 30 provides the pathway between annular space 31 and the exterior of well 12. This pathway is isolated from annular space 28, through which conduit 30 passes. The path of conduit 30 through inner casing 28 may be configured such that there is substantially no fluid exchange of fluid between annular space 31 and annular space 28 around the exterior of conduit 30.

In one embodiment, well interface appliance 14 is configured to be inserted in outer casing 24 and inner casing 26 from the exterior. This may be accomplished by drilling a hole in outer casing 24 and inner casing 26 that will accommodate well interface appliance 14 as shown in FIG. 1, or by inserting well interface appliance 14 into a portion of outer casing 24 and inner casing 26 that has been previously prepared for interface appliance 14 by some technique other than drilling. In one embodiment, well interface appliance 14 includes an Annular Drilling Tool, as provided by Oceaneering.

The pathway between annular space 31 and the exterior of well 12 provided by well interface appliance 14 may prevent well collapses during changes of temperature within well 12. For example, as temperature within well 12 increases and corresponding increase in pressure commences, fluid in annular space 31 may be bled out of well 12 through well interface appliance 14, thereby alleviating the pressure within annular space 31. Similarly, as temperature within 12 decreases and the volume of the fluid within annular space 31 also begins to decrease, fluid may be let back into annular space 31 through well interface appliance 14. If fluid was only drained from annular space 31 via check valve without replacement, cooling within well 12 after fluid has been drained could result in an implosive failure caused by reduced pressure within annular space 31 (e.g., compression force on outer casing 26 and burst force on tubular 29) as pressure drops.

The conduit 16 is configured to be connected to proximal end 32 of conduit 30, and to provide a pathway for fluid between well interface appliance 14 and one or more of the other components of system 10. For example, conduit 16 may convey fluid between well interface appliance 14 and reservoir 18 and/or junction 20. In one embodiment, conduit 16 is formed at least in part from a flexible hose. The hose may be corrosion and/or burst resistant.

The reservoir 18 is configured to sit underwater between the surface of the sea and the seabed (e.g., on the seabed, floating between the surface and the seabed, etc.). The reservoir 18 is coupled to conduit 16 at an end of conduit 16 that is opposite the connection between conduit 16 and well interface appliance 14. As such, reservoir 18 is in fluid communication with well interface appliance 14 via conduit 16. Fluid passing out of annular space 31 through conduit 30 and conduit 16 is directed by conduit 16 into reservoir 18 for storage. Fluid passing into annular space 28 through conduit 30 is directed to conduit 30 from reservoir 18 by conduit 16.

The reservoir 18 is configured to maintain fluid held therein in isolation from the water in which reservoir 18 is disposed (e.g., the sea). This prevents contamination of annular space 31 due to the introduction of seawater. For example, introduction of seawater to the interior of well 12 may cause corrosion of steel within well 12 (e.g., inner casing 26) by bacteria and/or chlorine. In one embodiment, substances combating corrosion within well 12 may be introduced into well 12 through system 10. For example, reservoir 18 may be pre-charged with such substances, and/or such substances may be replenished within reservoir 18 through a supply feed (not shown).

As was discussed above, if temperatures within well 12 increase, pressure within annular space 31 also tends to increase. However, in response to an increase in pressure, fluid may be bled from annular space 31 into reservoir 18 through conduit 16. This will enable the pressure within annular space 31 to be regulated even as temperature escalates. Then, as temperature is reduced, the fluid that was bled from annular space 31 can be re-introduced back into annular space 31 so that the well does not fail due to vacuum in annular space 31.

It will be appreciated that configuring reservoir 18 to have a volume that expands under pressure may be accomplished in one or more of a variety of ways. For example, reservoir 18 may include a piston. A force may be applied to the piston that causes the piston to compress the body of fluid held by reservoir 18. As the pressure within reservoir 18 increases, the pressure of the fluid overcomes the force applied to the piston and causes the piston to move, thereby increasing the volume held by reservoir 18. As the pressure within reservoir 18 decreases, the force applied to the piston becomes stronger than the force applied by the fluid, which causes the piston to move in the opposite direction, thereby decreasing the volume held by reservoir 18. The force applied to the piston may be applied by seawater on the outside of reservoir 18.

In one embodiment, reservoir 18 is formed at least in part by a pliable material. For example, reservoir 18 may be formed from a length of high pressure, reinforced hose capable of sustaining maximum expected internal pressure, yet pliable enough to permit a degree of collapse/constriction as a means to maintain internal pressure at sea hydrostatic pressure. The hose may be gas charged to provide a degree of compressibility. Other constructions/configurations for reservoir are contemplated (e.g., as described below). The volume of reservoir 18 will be maintained at the volume of whatever fluid is inside at hydrostatic pressure (assuming that the seawater is permitted to impinge on the outer surface of the pliable material). As fluid is permitted to pass out of annular space 31 and reservoir 18, the volume of reservoir 18 will grow. Then, when temperatures within well 12 cool, the hydrostatic pressure of the seawater on the exterior of reservoir 18 will push the fluid back into annular space 31.

In one embodiment, the volume of fluid from annular space 31 received by reservoir 18 in response to pressure increases within annular space 31 is not controlled entirely by the physical volume of reservoir 18. The reservoir 18 may be pre-charged with a fluid (e.g., a gas) that is compressed by inflows of fluid from annular space 31. The pre-charged fluid may be selected so as to be compressible by fluid from annular space 31 as pressure within annular space 31 increases. However, as pressure within annular space 31 decreases, the pre-charged fluid may exert a force on the fluid from annular space 31 that forces the fluid from annular space 31 back to annular space 31. The pre-charged fluid may include, Aqueous or non-aqueous fluids which may contain chemicals know to control/inhibit inorganic and organic forms of corrosion, bacterial growth, etc as typically practiced with conventional annular fluids, and/or other fluids.

In one embodiment, reservoir 18 is housed inside of a housing 36. The housing 36 may be configured to communicate seawater to its interior such that the exterior of reservoir 18 is hydrostatic.

The junction 20 is installed to communicate with fluid as it flows through conduit 16 between well interface appliance 14 and reservoir 18. In one embodiment, junction 20 is connected to conduit 16 in line between well interface appliance 14 and reservoir 18. The junction 20 provides a structure in which one or more other components of system 10 are disposed. These components may include, for example, one or more pressure transducers 38, one or more valves 40, and/or other components.

The pressure transducer 38 is configured to generate one or more output signals conveying information related to the pressure of fluid within system 10. The output signals may convey information related to pressure within conduit 16 and/or reservoir 18. The output signals may be provided to the surface for presentation to an operator of system 10 (e.g., at user interface 22). The output signals may be implemented within system 10 to control other components of system 10 (e.g., valve 40 as described below). It will be appreciated that the disposition of pressure transducer 38 on junction 20 is not intended to be limiting. In one embodiment, pressure transducer 38 includes a pressure transducer at or near well interface appliance 14. In one embodiment, pressure transducer 38 includes a pressure transducer at or near reservoir 18.

The valve 40 is configured to control fluid flow through conduit 16. In one embodiment, valve 40 defines one or more valve openings through which fluid traveling through conduit 16 must pass. By changing one or more parameters of the valve opening(s) (e.g., area, height, width, shape, etc.), conduit 16 may control fluid flows through conduit 16. For example, valve 40 may be configured to shut down fluid flows through conduit 16 until pressure within annular space 31 reaches some pressure threshold. In response to pressure breaching the pressure threshold, valve 40 may open to allow fluid to flow from annular space 31 into reservoir 18. Determination as to whether pressure has breached the pressure threshold may be made based on the output signals generated by pressure transducer 38. In one embodiment, valve 40 includes a mechanical check-valve configured to respond mechanically to a pressure differential between annular space 31 and reservoir 18 by opening to enable the pressure to reach equilibrium between annular space 31 and reservoir 18. It will be appreciated the illustration of valve 40 on junction 20 is not intended to be limiting. In one embodiment, valve 40 includes one or more valves disposed at or near well interface appliance 14. In one embodiment, valve 40 includes one or more valves at or near reservoir 18. The valve 40 may include a single valve, or a plurality of valves (e.g., one regulating flows from annular space 31 to reservoir 18 and one regulating flows from reservoir 18 to annular space 31).

In one embodiment, system 10 further includes a pressure relief valve 42. The pressure relief valve 42 is configured to relieve pressure within the annular space 31/reservoir 18 system by releasing fluid (e.g., gas and/or liquid) from reservoir 18 and/or conduit 16 into the sea. There may be operating conditions under which, even with reservoir 18 operating to regulate pressure within annular space 31, pressure within annular space 31 reaches levels that threaten failure of well 12. However, under such operating conditions, pressure relief valve 42 releases fluid from reservoir 18 and/or conduit 16, which in turn relieves pressure in annular space 31.

In one embodiment, pressure relief valve 42 is a one-way valve. In one embodiment, pressure relief valve 42 includes a valve the permits seawater to enter conduit 16 and/or reservoir 18 as temperatures within well 12 subside. The pressure relief valve 42 may be disposed at or near reservoir 18, away from well interface appliance 14. This may result in a larger amount of the seawater remaining within reservoir 18 and/or conduit 16, and not flowing all the way into annular space 31. While the seawater may cause damage to reservoir 18 and/or conduit 16, these components of system 10 may be replaceable at a lower cost than outer casing 24, inner casing 26, and/or tubular.

It will be appreciated that the illustration in FIG. 1 of a single entity for each of well interface appliance 14, conduit 16, and/or reservoir 18 is not intended to be limiting. In one embodiment, well interface appliance 14 includes a plurality of appliances that interface with well 12 (e.g., at a variety of different depths and/or with a plurality of annular spaces within well 12). In one embodiment, conduit 16 includes two or more lines between well interface appliance 14 and reservoir 18. For example, one line may be used for flows from well interface appliance 14 while a second line is used for flows of fluid from reservoir 18 to well interface appliance 14. In one embodiment, reservoir 18 includes a plurality of reservoirs that are in communication with annular space 31 via conduit 16 and well interface appliance 14. These reservoirs may be connected in series, in parallel, and/or may be selectively and/or controllably linked with annular space 31 on an individual (or group) basis. In embodiments in which system 10 includes a plurality of well interface appliances 14, conduits 16, and/or reservoirs 18, junction 20 may be configured as a manifold, with valves 40 controlling flows of fluid between the various well interface appliances 14, conduits 16, and/or reservoirs 18.

In one embodiment, reservoir 18 and conduit 16 are not formed as separate components. For example, reservoir 18 may include an elongated body that connects directly to interface appliance 14. The elongated body may be resiliently flexible and/or pre-charged in the manner discussed above with respect to reservoir 18. In this embodiment, the elongated boy performs the functionality attributed above to both reservoir 18 and conduit 16.

The user interface 22 is configured to provide an interface between system 10 and one or more users through which the users may provide information to and receive information from system 10. This enables data, results, controls and/or instructions and any other communicable items, collectively referred to as "information," to be communicated between the users and one or more of well interface appliance 14, valve 40, reservoir 18, junction 20, and/or other components of system 10. Through user interface 22, the users may monitor the operation of system 10 (e.g., the level of reservoir 18, pressure within annular space 28 and/or reservoir 18, the operation state of valve 40, etc.).

Examples of interface devices suitable for inclusion in user interface 22 include a keypad, buttons, switches, a keyboard, knobs, levers, a display screen, a touch screen, speakers, a microphone, an indicator light, an audible alarm, and a printer. It is to be understood that other communication techniques, either hard-wired or wireless, are also contemplated by the present invention as user interface 22. Other exemplary input devices and techniques adapted for use with system 10 as user interface 22 include, but are not limited to, an RS-232 port, RF link, an IR link, modem (telephone, cable or other). In short, any technique for communicating information with system 10 is contemplated by the present invention as user interface 22.

Figure 2:
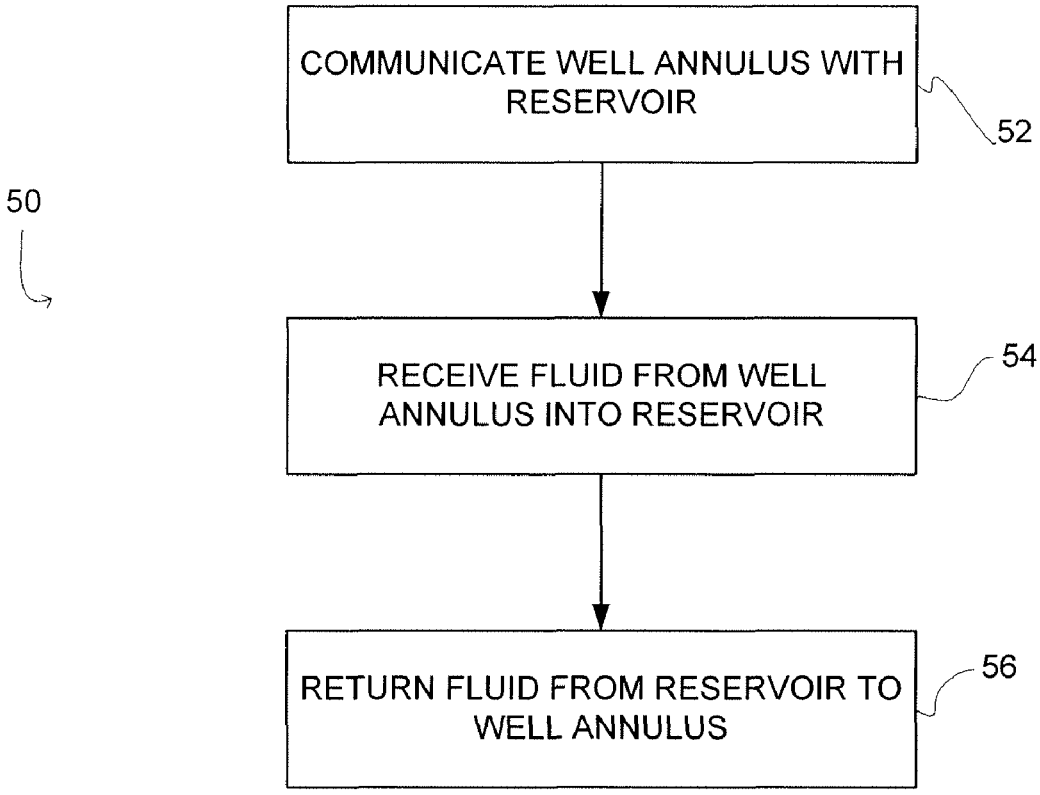
FIG. 2 illustrates a method of managing pressure within a sub-sea well, according to one or more embodiments of the invention.

FIG. 2 illustrates a method 50 of regulating pressure within a well annulus. The operations of method 50 presented below are intended to be illustrative. In some embodiments, method 50 may be accomplished with one or more additional operations not described, and/or without one or more of the operations discussed. Additionally, the order in which the operations of method 50 are illustrated in FIG. 2 and described below is not intended to be limiting.

At an operation 52 a well annulus of a sea-based mineral extraction well is placed in fluid communication with a reservoir that is external to the well. The reservoir sits within the sea at or near the seabed. In one embodiment, operation 52 places a reservoir similar to or the same as reservoir 18 (shown in FIG. 1 and described above) in communication with a well annulus similar to or the same as annular space 31 (shown in FIG. 1 and described above). In one embodiment, operation 52 is performed by a well interface appliance and/or conduit similar to or the same as well interface appliance 14 and/or conduit 16, respectively (shown in FIG. 1 and described above).

At an operation 54, responsive to pressure within the well annulus increasing, fluid from within the well annulus is received into the reservoir. The increase in pressure within the well annulus may be caused by extraction through the well.

At an operation 56, responsive to pressure within the well annulus decreasing, fluid from the reservoir is provided back to the well annulus. The decrease in pressure within the well annulus may be caused by a cessation or pause of extraction activities and/or by injection of cooler fluids into the well, such as well kill and stimulation operations. While the fluid is outside of the well annulus, the fluid is maintained in isolation from seawater to prevent contamination and/or corrosion within the well annulus when the fluid is reintroduced back into the well annulus at operation 56.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A system configured to extract minerals from a subterranean reservoir through a body of water and through a seabed the system comprising:

a mineral extraction well that is prepared for mineral extraction, the well comprising:

a tubular through which fluids including minerals are extracted; and a casing within which the tubular is provided such that a well annulus is formed between the tubular and the casing;

one or more conduits installed in an outer wall of the completed well between a surface of the body of water and the seabed such that the one or more conduits pass through the casing to communicate with the well annulus, the one or more conduits providing one or more pathways through which fluid is communicated between the well annulus and the exterior of the well; and one or more reservoirs configured to sit between the surface of the body of water and the seabed, the one or more reservoirs being in fluid communication with the one or more conduits such that fluid passing out of the well annulus via the one or more conduits is received into the one or more reservoirs, and such that fluid passing into the well annulus via the one or more conduits comes from the one or more reservoirs, wherein the one or more conduits and the one or more reservoirs are configured such that, responsive to temperature changes caused by mineral extraction through the well, pressure within the well annulus is regulated by flows of fluid into and out of the well annulus.

2. The system of claim 1, further comprising one or more valves configured to selectively control flows of fluid between the well annulus and the one or more reservoirs.

3. The system of claim 1, wherein the one or more reservoirs are configured to sit at or near the seabed.

4. The system of claim 1, wherein a volume of the one or more reservoirs expands in response to fluid flowing from the well annulus into the one or more reservoirs.

5. The system of claim 4, wherein pressure within the one or more reservoirs maintained substantially equal to pressure within the well annulus by virtue of the fluid communication therebetween, and wherein the one or more reservoirs are formed from a pliable material so that the volume of the one or more reservoirs expands elastically to accept fluid from within the well annulus.

6. The system of claim 5, wherein the one or more reservoirs are kept at hydrostatic pressure by exposing the exterior of the one or more reservoirs to the water in the body of water.

7. The system of claim 5, wherein the one or more reservoirs comprise a piston that elastically expands the volume of the one or more reservoirs under pressure.

8. The system of claim 1, further comprising a pressure transducer configured to generate an output signal conveying information related to pressure within the well annulus and/or the one or more reservoirs.

9. The system of claim 1, further comprising a pressure relief valve in fluid communication with the well annulus and the one or more reservoirs, the pressure relief valve being configured to release fluid from within the well annulus and/or the one or more reservoirs into the body of water in response to pressure in the well annulus and/or the one or more reservoirs rising above a threshold pressure.

10. A system configured to extract fossil fuel from a subterranean reservoir through a body of water and through a seabed, the system comprising:

a mineral extraction well that is prepared for extraction of fossil fuel, the well comprising:

a tubular through which fossil fuel is extracted; and a casing within which the tubular is provided such that a well annulus is formed between the tubular and the casing;

an annular drilling tool installed in the well to provide communication between the well annulus and the exterior of the well within the body of water;

one or more conduits configured to receive fluid from and provide fluid to the annular drilling tool such that fluid passes back and forth between the well annulus and the one or more conduits through the annular drilling tool; and one or more reservoirs configured to sit between the surface of the body of water and the seabed, the one or more reservoirs being in fluid communication with the one or more conduits such that fluid passing out of the well annulus via the annular drilling tool and the one or more conduits is received into the one or more reservoirs, and such that fluid passing into the well annulus via the one or more conduits and the annular drilling tool comes from the one or more reservoirs, wherein the one or more conduits and the one or more reservoirs are configured such that, responsive to temperature changes caused by fossil fuel extraction through the well, pressure within the well annulus is regulated by flows of fluid into and out of the well annulus.

11. The system of claim 10, further comprising one or more valves configured to selectively control flows of fluid between the annular drilling tool and the one or more reservoirs.

12. The system of claim 10, wherein the one or more reservoirs are configured to sit at or near the seabed.

13. The system of claim 10, wherein a volume of the one or more reservoirs expands in response to fluid flowing from the well annulus into the one or more reservoirs.

14. The system of claim 13, wherein pressure within the one or more reservoirs maintained substantially equal to pressure within the well annulus by virtue of the fluid communication therebetween, and wherein the one or more reservoirs are formed from a pliable material so that the volume of the one or more reservoirs expands elastically to accept fluid from within the well annulus.

15. The system of claim 14, wherein the one or more reservoirs are kept at hydrostatic pressure by exposing the exterior of the one or more reservoirs to the water in the body of water.

16. The system of claim 13, wherein the one or more reservoirs comprise a piston that elastically expands the volume of the one or more reservoirs under pressure.

17. The system of claim 10, further comprising a pressure transducer configured to generate an output signal conveying information related to pressure within the well annulus and/or the one or more reservoirs.

18. The system of claim 10, further comprising a pressure relief valve in fluid communication with the annular drilling tool and the one or more reservoirs, the pressure relief valve being configured to release fluid from within the well annulus and/or the one or more reservoirs into the body of water in response to pressure in the well annulus and/or the one or more reservoirs rising above a threshold pressure.

19. A method of regulating pressure within a well annulus of a mineral extraction well that extends down through a body of water and through a seabed, the well including a tubular through which fluids including minerals are extracted, and a casing within which the tubular is provided such that the well annulus is formed between the tubular and the casing, the method comprising:

responsive to a temperature increase in the well caused by the extraction of fluids through the tubular, regulating pressure in the well annulus by receiving fluid from the well annulus through a conduit that communicates with the well annulus through the casing within the body of water; and responsive to a temperature decrease in the well caused by a cessation or slowing of the extraction of fluids through the tubular, regulating pressure in the well annulus by re-introducing fluid previously received from the well annulus back into the well annulus through the conduit.

20. The method of claim 19, further comprising storing fluid received from the well annulus through the conduit in a reservoir disposed within the body of water.

* * * * *